US008009059B2

(12) United States Patent
Huang et al.

(10) Patent No.: US 8,009,059 B2
(45) Date of Patent: Aug. 30, 2011

(54) DOWNHOLE POWER GENERATION AND COMMUNICATIONS APPARATUS AND METHOD

(75) Inventors: Songming Huang, Hardwick (GB); Franck Monmont, Caldecote (GB); Kasim Sadikoglu, Lower Cambourne (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 794 days.

(21) Appl. No.: 10/569,707

(22) PCT Filed: Sep. 2, 2004

(86) PCT No.: PCT/GB2004/003753

§ 371 (c)(1),
(2), (4) Date: Aug. 23, 2006

(87) PCT Pub. No.: WO2005/024177

PCT Pub. Date: Mar. 17, 2005

(65) Prior Publication Data

US 2007/0194947 A1 Aug. 23, 2007

(30) Foreign Application Priority Data

Sep. 5, 2003 (GB) ..... 0320804.8

(51) Int. Cl.
*E21B 47/12* (2006.01)

(52) U.S. Cl. ..... 340/853.3; 367/82

(58) Field of Classification Search ..... 367/82; 340/853.3

See application file for complete search history.

(56) References Cited

U.S. PATENT DOCUMENTS

| | | | | |
|---|---|---|---|---|
| 3,659,259 | A | 4/1972 | Chaney, Jr. et al. | |
| 3,789,355 | A | 1/1974 | Patton | |
| 3,964,556 | A | 6/1976 | Gearhart et al. | |
| 4,669,068 | A * | 5/1987 | Klatt | 367/83 |
| 5,283,768 | A | 2/1994 | Rorden | |
| 5,839,508 | A | 11/1998 | Tubel et al. | |
| 5,924,499 | A | 7/1999 | Birchak et al. | |
| 6,172,614 | B1 | 1/2001 | Robison et al. | |
| 6,304,176 | B1 * | 10/2001 | Discenzo | 340/539.26 |
| 6,442,105 | B1 | 8/2002 | Tubel et al. | |
| 6,464,011 | B2 * | 10/2002 | Tubel | 166/313 |
| 6,757,218 | B2 * | 6/2004 | Dubinsky | 367/83 |
| 7,397,388 | B2 * | 7/2008 | Huang et al. | 340/853.3 |
| 2003/0026167 | A1 | 2/2003 | Hahn et al. | |
| 2003/0086336 | A1 | 5/2003 | Dubinsky | |
| 2003/0116969 | A1 | 6/2003 | Skinner et al. | |

FOREIGN PATENT DOCUMENTS

| | | | |
|---|---|---|---|
| EP | 0 685 628 | A1 | 12/1995 |
| EP | 1 302 624 | A1 | 4/2003 |
| GB | 2 343 537 | A | 5/2000 |
| GB | 2 348 029 | A | 9/2000 |
| GB | 2 380 065 | A | 3/2003 |
| GB | 2 399 921 | A | 9/2004 |
| WO | 96/09561 | A1 | 3/1996 |
| WO | 02/27139 | A1 | 4/2002 |
| WO | 03/067029 | A1 | 8/2003 |

* cited by examiner

*Primary Examiner* — Brian Zimmerman
*Assistant Examiner* — Hung Q Dang
(74) *Attorney, Agent, or Firm* — Helene Raybaud; Brigid Laffey; Rachel Greene

(57) ABSTRACT

Apparatuses and methods to power and communicate with downhole sensors are presented. Preferred embodiments of the present invention includes energizing a downhole sensor with a surface pressure wave generator and a downhole mechanical to electrical energy converter. Preferred embodiments of the present invention also include transmitting data measured from a downhole sensor to a surface unit through modulation of surface-generated pressure waves.

18 Claims, 5 Drawing Sheets

DOWNHOLE POWER GENERATION AND COMMUNICATIONS APPARATUS AND METHOD

CROSS-REFERENCE TO RELATED APPLICATIONS

This application claims the benefits of priority from:

i) Application Number 0320804.8, entitled "DOWNHOLE POWER GENERATION AND COMMUNICATIONS APPARATUS AND METHOD," filed in the United Kingdom on Sep. 5, 2003; and ii) Application Number PCT/GB2004/003753, entitled "DOWNHOLE POWER GENERATION AND COMMUNICATIONS APPARATUS AND METHOD," filed under the PCT on Sep. 2, 2004;

All of which are commonly assigned to assignee of the present invention and hereby incorporated by reference in their entirety.

BACKGROUND OF THE INVENTION

The present invention generally relates to communications with the long-term placement of downhole completions equipment. More particularly, the present invention relates to an apparatus and method to wirelessly communicate with downhole completions equipment. More particularly still, the present invention relates to methods and apparatuses to wirelessly communicate with and generate power for downhole completions equipment, particularly those permanently installed in the well.

Because of the variety of sensor and measurement devices used in oilfield drilling and production operations, various communication systems and schemes are often necessary. One form of communications that continually challenges the industry relates to the communication between surface and downhole equipment. Particularly, it is often necessary to retrieve data from downhole equipment and sensors for processing and decision-making at the surface. Operations such as drilling, perforating, fracturing, drill stem or well testing, and hydrocarbon production require measurements of downhole pressures and temperatures at various depths of investigation. Furthermore, communication from the surface to downhole sensors is often desired as some sensors or downhole tools accept commands from the surface to direct their operation.

One aspect of downhole communications that necessitates further innovation and invention involves the communications between surface equipment and downhole "smart" completions equipment. Completion generally refers to the process by which a drilled wellbore is "completed" or prepared to produce hydrocarbons therethrough. Typically, the completions process follows drilling, casing, and perforating operations undertaken to reach the subterranean reservoir. Thereafter, completions usually involve the installation of at least one string of production tubing, various packer assemblies, and other downhole tools (such as valves, nipples, and pumps). The packers serve to isolate one or more production zones from other portions of the wellbore depth while the production tubing serves as a conduit to carry the hydrocarbons from the isolated zone to the surface.

Additionally, the phrase "smart completions" generally refers to the placement of downhole measurement devices, usually temperature and pressure sensors, to monitor the production of the reservoir. The data from the smart completions equipment is evaluated at the surface so that decisions can be made regarding production methods and techniques in order to maximize the lifetime and productivity of the well. Because completions equipment is expected to last the entire life of the well, smart completions systems capable of lasting upwards of 15 years are necessary. Therefore, systems that rely on batteries or other stored power devices are generally not sufficient for the life of smart or other permanent completions systems. Currently, the monitoring of smart or permanent completions equipment is periodic in nature but this is subject to change as more detailed and complex measurements are enabled. Therefore, there is a long-felt need in the industry for a long-term, permanent, communication system for smart or permanent completions devices.

Accurate and reliable downhole communication is necessary when transmitting and processing complex data or data from several sensors simultaneously. For these operations, digital communication schemes are often preferred since they have improved reliability and readability over analog signals. A digital communication, one typically consisting of strings of 0s and 1s, is more reliably read and verified on the surface than it's analog counterpart. However, for digital communications to be possible between downhole sensors and surface equipment, advanced electronics, those capable of turning the analog temperature and pressure measurements into digital data streams, are needed. As the amount of data processing increases downhole, so do the power demands of such equipment. For this reason, a system to deliver power to downhole completions equipment is also highly desirable. Most desirable of all is a system to perform digital communications and transfer power between downhole sensors and surface equipment.

Formerly, direct wireline connections were used to transfer power and communications data between the surface and the downhole location. While much effort has been spent on wireline communication, its inherent high telemetry rate and power transmission capacity is not always needed and very often does not justify the high cost of deploying and installing thousands of feet of permanent or temporary wireline in a wellbore.

Additionally, acoustic and electromagnetic wave telemetry has been explored whereby a conduit containing a transmission medium is deployed to a depth of investigation. While such systems are promising, they suffer from similar cost problems resulting from their short or long term placement. Among those techniques that use liquids as medium are the well-established Measurement While Drilling (MWD) techniques. A common element of the MWD and related methods is the use of a flowing medium, e.g., the drilling fluids pumped during the drilling operation. This requirement however prevents the use of MWD techniques in operations during which a flowing medium is not available.

In recognition of this limitation various systems of acoustic transmission in a liquid independent of movement have been put forward, for example in U.S. Pat. Nos. 3,659,259; 3,964,556; 5,283,768 or 6,442,105. Most previously known approaches are either severely limited in scope and operability or require downhole transmitters that consume large amounts of energy.

It is therefore an object of the present invention to provide a communication system that overcomes the limitations of existing devices to allow the communication of data between a downhole location and a surface location.

SUMMARY OF THE INVENTION

The deficiencies of the prior art can be addressed by an apparatus to communicate with a downhole sensor. The apparatus preferably includes a surface unit including a pressure wave generator and a signal processing unit. The apparatus also preferably includes a downhole energy converter configured to convert pressure fluctuations from the pressure wave generator to electrical energy. The apparatus also preferably includes an energy storage device configured to store electrical energy from said energy converter. The apparatus also preferably includes a control module configured to receive data from the downhole sensor and to transmit the data to the signal processing unit through a pressure wave telemetry unit.

The deficiencies of the prior art can also be addressed by a method to communicate with a downhole sensor. The method preferably includes activating a surface pressure wave generator to excite a downhole energy converter. The method also preferably includes storing energy from the downhole energy converter in a downhole energy storage device. The method also preferably includes accumulating data in a downhole control module from the downhole sensor. The method also preferably includes sending a ready signal from the downhole control module. The method also preferably includes modulating a pressure wave telemetry unit with the downhole control module. The method also preferably includes transmitting the data from the downhole control module to a surface signal processing unit.

DETAILED DESCRIPTION OF THE PREFERRED EMBODIMENTS

Figure 1:
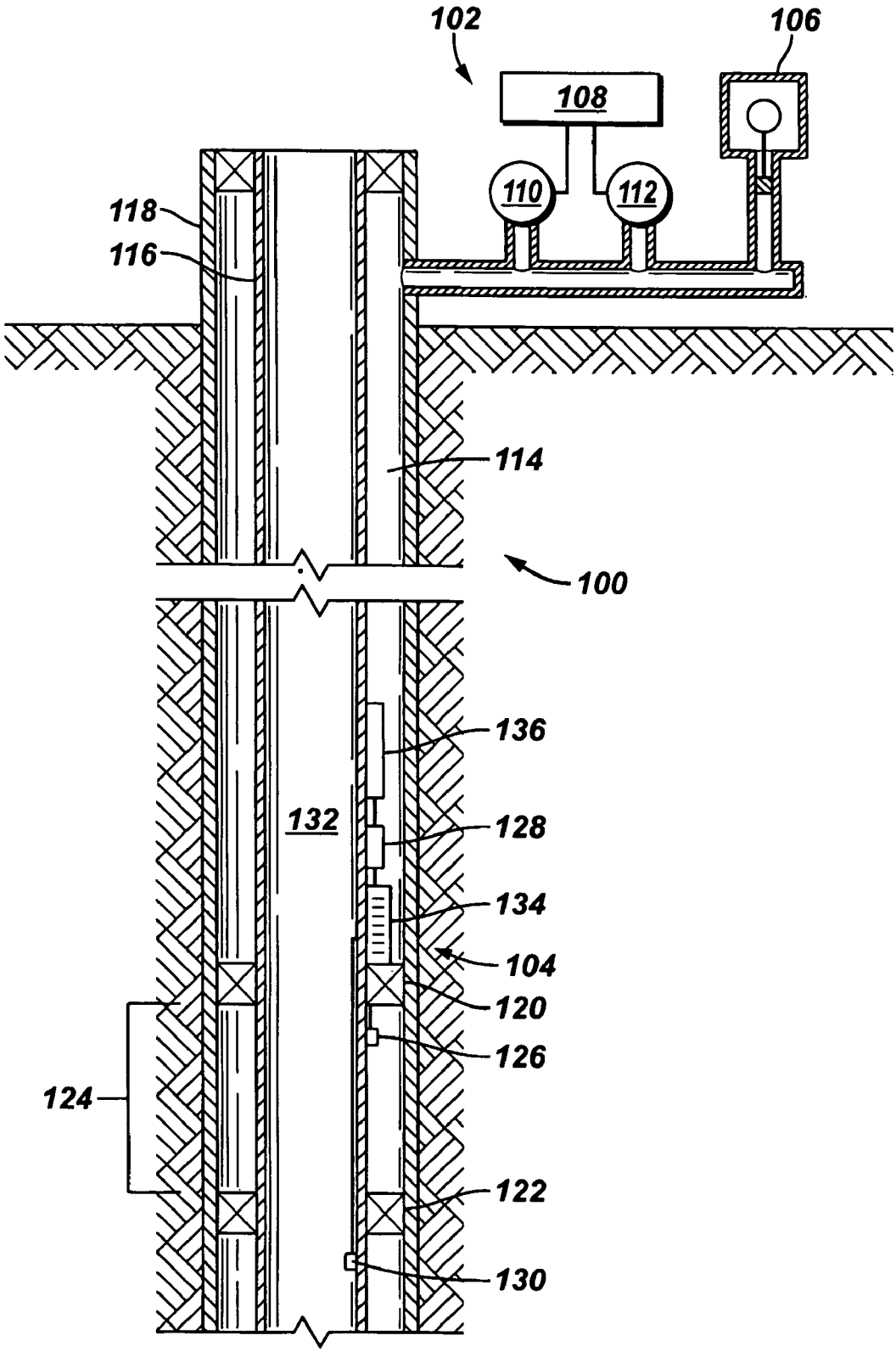
FIG. 1 is a schematic representation of a downhole communications system in accordance with preferred embodiments of the present invention.

Referring initially to FIG. 1, a downhole communications system 100 is shown schematically. Downhole communications system 100 preferably includes a surface unit 102 and a downhole communications package 104. Surface unit 102 preferably includes a pressure wave generator 106, a signal processing unit 108, and pressure transducers 110, 112. Pressure wave generator 106 is shown as a piston-type pressure generator that includes a motor driven piston producing a reciprocal movement within a cylinder but may be of any type known in the art. Surface unit transmits, receives, and analyzes pressure wave signals to and from communications package 104.

Communications package 104 is shown located downhole in an annulus 114 between strings of production tubing 116 and casing 118. Ideally, packers 120, 122 isolate sections of strings 116, 118 so that distinct measurements in a zone of investigation 124 can be taken by downhole sensor package 126 (downhole sensor). Downhole sensor package 126 can be of any type known to one skilled in the field of hydrocarbon production, but typically will include pressure and temperature sensing devices that are capable of operating with minimal power input. Downhole sensor package 126 is preferably connected to a downhole control module 128 where the data therefrom can be accumulated, converted to digital bit streams, and transmitted to surface unit 102 for analysis. Furthermore, additional sensors 130 from production tubing bore 132 or other zones of investigation may also tie back to downhole control module 128 for transmission to surface unit 102.

Ideally, control module 128 is constructed as a low power-consuming computational device capable of regulating numerous downhole processes. While control module 128 may be constructed as several individual components including, but not limited to, data processing, valve actuation, data transmission, and electrical regulatory components connected together by a communication protocols, module 128 is shown in Figure schematically as a single component for simplicity.

A power generation and storage system 134 is preferably connected to control module 128. Power generation and storage system 134 preferably includes an energy storage module (not shown in detail) and an energy conversion module (not shown in detail). Energy storage module is preferably a bank of capacitors or any other energy storage means known to one skilled in the art. Energy conversion module preferably converts mechanical energy to electrical energy through magnetostrictive, electrostrictive, or piezoelectric materials. Furthermore, the converter can be based on any appropriate mechanical to electrical energy conversion device, for example, a hydrophone based on electromagnetic induction.

Piezoelectric materials generate electrical currents when placed under pressures. In devices using piezoelectric components, pressure waves generate electric charges between two electrodes separated by piezoelectric material with appropriate strain-sensitive orientation. Typically, the more piezoelectric material used, the more electric charge generated. Therefore, in order to be feasible as a downhole generator, a stack of multi-layer piezoelectric material interlaced with metal electrodes is often employed. These stacked materials are typically constructed as a cylindrical or tubular shape. For a pressure wave of amplitude P and angular frequency ω, a stack of piezoelectric material with n layers having a cross-sectional area of A is capable of producing an alternating current of:

$$i=d_{33}nA\omega P \qquad \text{Eq. 1}$$

where $d_{33}$ is the piezoelectric coefficient of the material used. Assuming a wave, with 0.1 MPa (1-bar) amplitude and 20 Hz frequency applied to a 100 layer piezoelectric stack with a coefficient of $3.5\times10^{-10}$ C/N (PZT Ceramic) and a cross-sectional area of 0.01 $m^2$, the electrical current generated would have amplitude of 4.4 mA. This current would then be routed to charge a large capacitor $C_s$ through a full-wave rectifier as shown in FIG. 2.

Figure 2:
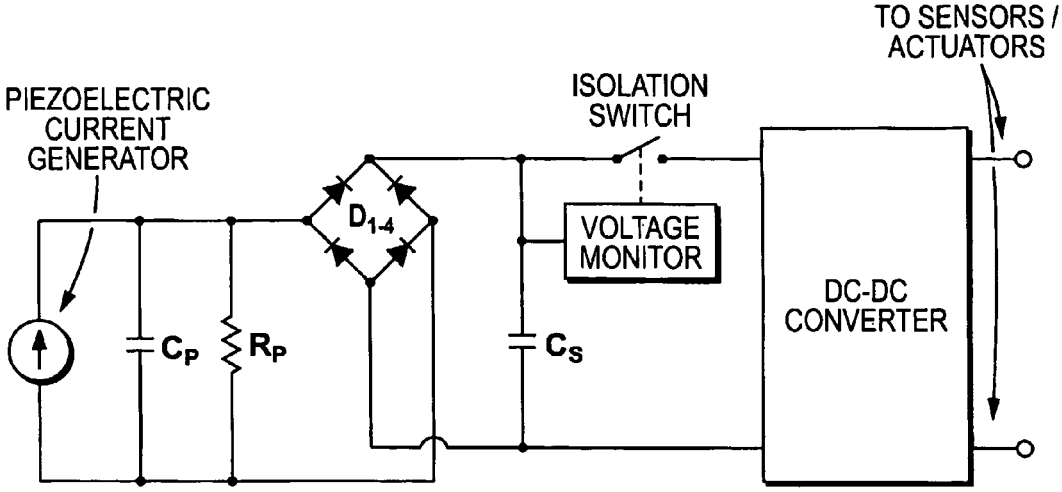
FIG. 2 is a schematic representation of a voltage rectifier circuit in accordance with preferred embodiments of the present invention.

Referring to FIG. 2, the piezoelectric device is represented by a current source in parallel with its intrinsic capacitance $C_p$ and shunt resistance $R_p$. The full-wave rectifier is implemented by 4 diodes D1, D2, D3, and D4. Provided that the charge storing capacitance $C_s$ is large compared with the intrinsic capacitance $C_p$, most of the current generated by the piezoelectric device is charged into $C_s$. The average direct current charging can be obtained by integrating the rectified current waveform over its period:

$$I_c = \frac{2}{\pi} i \qquad \text{Eq. 2}$$

During a finite charging period, $I_c$ can be approximately equivalent to a constant charging current, and the electrical energy stored in $C_s$ increases with charging time, T. Therefore:

$$E = \frac{I_c^2 T^2}{2C_s} \qquad \text{Eq. 3}$$

Taking $I_c$ to be 2.8 mA and $C_s$ to be 0.01 F, the energy stored in $C_s$ can reach 348 joules after 10 minutes of charging. If the electronics of the down-hole sensors have a power consumption of 1 Watt, then, without considering various losses, this energy could sustain data acquisition for 348 seconds. Charging time can be increased if a longer acquisition or higher power consumption is required.

The voltage monitor and isolation switch in FIG. 2 can be used to help save energy whereby the charging capacitor is isolated from the load circuits until the voltage of the capacitor exceeds a predetermined level. When the voltage on the capacitor exceeds this level, the accumulation of sufficient energy for an acquisition cycle is indicated and the DC-to-DC converter is used to convert the voltage across the capacitor to a level required by the load circuits in sensors and actuators.

Figure 3:
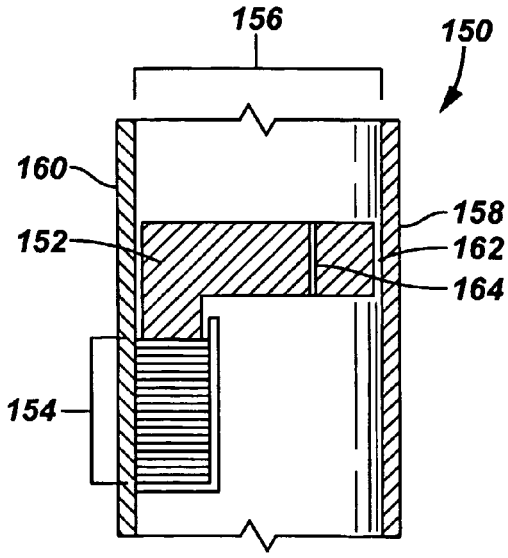
FIG. 3 is a schematic representation of a mechanical to electrical energy converter in accordance with preferred embodiments of the present invention.

Referring now to FIG. 3, an improved system and method to convert from mechanical to electrical energy is shown. FIG. 3 shows a resonator system 150 created by adding a mass 152 to the energy conversion device (e.g. piezoelectric stack) 154. Resonator system 150 is shown located in an annulus 156 formed between a string of casing 158 and a string of inner tubing 160. The stiffness s and mass M of the converter 154 determine the un-damped resonance frequency ω wherein:

$$\omega = \sqrt{\frac{s}{M}} \qquad \text{Eq. 4}$$

The fluid damping effect will make the actual resonance frequency lower than the un-damped frequency ω. The pressure wave frequency generated on surface can be matched to this actual resonance frequency to generate the maximum electrical energy output.

Furthermore, FIG. 3 illustrates another method using impedance matching to further improve energy conversion efficiency. For the same amount of active material, the energy conversion device can be made relatively thin and long to reduce the stiffness thereof. The mass 152 may be constructed as a piston with its fluid contacting surface area nearly as large as the annulus cross-section. In this configuration, the pressure wave generates a force:

$$F = pA \qquad \text{Eq. 5}$$

that converts to a pressure on the active material:

$$p_2 = p\frac{A}{A_2} \qquad \text{Eq. 6}$$

Therefore, the dynamic pressure is amplified by the ratio of the two areas A and $A_2$. The static pressure is balanced through gaps 162 around the edge of the piston and through any balancing holes 164 drilled on it.

Finally, single crystal piezoelectric materials (e.g. quartz) may be used in place of the multi-layered structure described above. However, it is widely known that piezoelectric materials have a limited functional lifetime and gradually degrade in performance over time. Particularly, under downhole conditions, this degradation can be somewhat accelerated even though the operating temperature of the well may be well below the Curie point of the material (e.g. 305° C. for PZT). While the exact downhole life of a piezoelectric material is not known, it is estimated that unprotected piezoelectric materials can operate effectively for only 10 years of less. For this reason, various measures can be taken to improve reliability and longevity of piezoelectric materials used downhole. Particularly, the piezoelectric material can be immersed in a protective fluid such as silicone oil and contained within a pressure transparent barrier. This barrier, constructed as an elastomeric bladder or a metal bellows device, would allow downhole pressure to act upon the piezoelectric material without risk of allowing the working fluid (mud, water, etc.) to come into contact with, and damage the piezoelectric material.

Alternatively, a magnetostrictive material such as TERFENOL-D may be used in place of piezoelectric material for mechanical to electrical converter. Using such materials, pressure waves acting thereupon produce a varying magnetization in the material, thereby inducing a current in a coiled wire that surrounds it. Magnetostrictive materials have the advantage of not degrading in performance over long term like piezoelectric materials. However, magnetostrictive devices generally will not have as high of conversion efficiency as the piezoelectric materials. For this reason, the selection of piezoelectric v. magnetostrictive materials will depend largely on the amount of energy needed to operate downhole sensors and transmit data therefrom back to the surface.

Referring again to FIG. 1, downhole communications package 104 includes a telemetry modulator 136 to transmit data received and processed from sensors 126 and 130 to surface unit 102. Telemetry modulator 136 preferably includes a low power actuator or solenoid and a pressure wave modulator (e.g. a Helmholtz-type resonator). Together, the modulator and actuator function to modify the pressure waves sent from pressure wave generator 106 of surface unit 102. Typically, these waves are transmitted from the surface unit to the downhole communications package where they are reflected and returned to the surface. Using telemetry modulator 136, the reflected waves are "shifted" in phase or otherwise modified (e.g. amplitude) so that these modifications can be detected by pressure transducers 110, 112 through signal processing unit 108 at the surface. This pressure wave modulation is transmitted as a series of "on" and "off" pulses thereby creating a binary data bit stream that can be decrypted by processing unit 108 into readable data. This data will often contain raw or processed information from downhole sensors 126, 130. Examples of pressure wave modulation telemetry systems (including Helmholtz resonators) can be found in United Kingdom Patent Applications GB 0306929.1 and GB 0320804.8, respectively filed on 26 Mar. 2003 and 5 Sep. 2003 by Songming Huang, et al.

Figure 4:
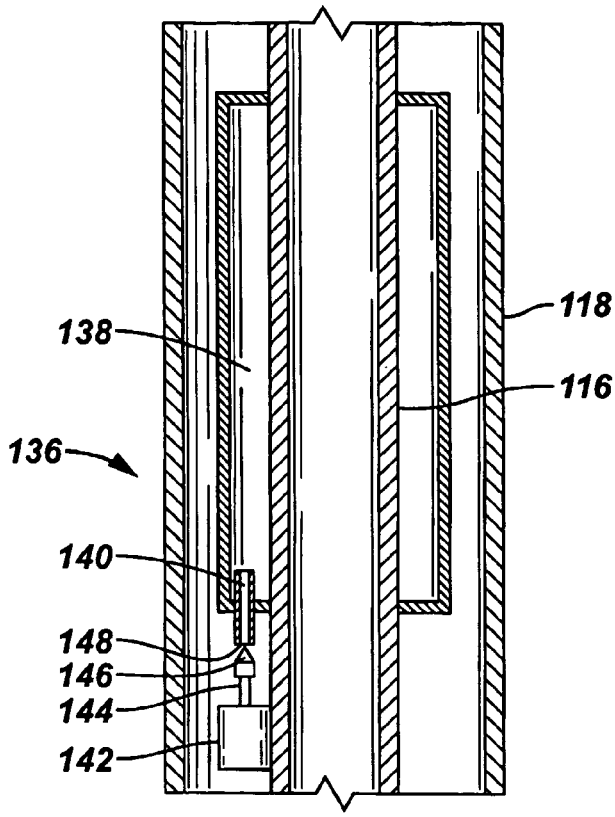
FIG. 4 is a cross-sectional schematic drawing of a telemetry modulation resonator in accordance with preferred embodiments of the present invention.

Referring to FIGS. 1 and 4 together, the telemetry from downhole communications package 104 to surface unit 102 can be described. Communications begins when a continuous sinusoidal carrier wave is generated by pressure wave generator 106 at the surface. This wave propagates down annulus 114 between tubing 116 and casing 118 and is reflected at a downhole termination (typically a packer 120, 122) and returns to the surface. Preferably, the frequency of the carrier wave is tuned to a resonance frequency of a downhole Helmholtz resonator assembly (telemetry module 136) that includes a fluid filled volume 138 and a narrow access tube 140 that links the fluid in reservoir 138 to the fluid in annulus 114.

Binary data bits are used to modulate a valve 142 that controls the acoustic communication through the fluid within tube 140. Valve 142 is preferably constructed as an actuator that includes an armature 144, and valve plunger 146 corresponding to a plunger seat 148 at the end of tube 140. For example, when a digit "1" is to be sent, valve 142 is closed and annulus 114 is terminated rigidly by packer 120. Therefore, the incoming wave is to be reflected back to the surface without any change in phase. When a digit "0" is to be sent, valve 142 is opened and the low impedance of resonator 136 (138+140) becomes the termination to the annulus. Therefore, the resultant reflected wave is phase-shifted by approximately 180° when received at surface unit 102. Therefore, the binary data is sent by the reflected pressure wave with a binary phase-shifting keying (BPSK) modulation. Pressure transducers 110, 112 at surface detect the reflected pressure wave and submit their output to signal processing unit 108 where the reflected wave is separated from the interference of the down-going carrier wave and demodulated to decrypt the transmitted data.

Finally, to protect telemetry modulator 136 from corrosion and jamming by solids found in the working fluid, the resonator inlet tube 140 and the valve 142 may be housed within a pressure transparent bellows or bladder. Such devices would be hydraulically transparent and preferably filled with a clean fluid such as silicone oil or de-ionized water to maximize the life of telemetry modulator 136. This design is capable of providing fluid isolation while still permitting pressure communication therethrough.

For permanent monitoring applications as envisioned by preferred embodiments of the present invention, it is important to minimize power consumption for the sensor electronics as well as the data telemetry modulation system. Low power components, such as CMOS devices, should be used in electronic circuits and optimized power management should be implemented wherever possible by switching off supply to sensors and circuits when not in use. One area where power conservation is possible is in relation to the transmittal of data to surface unit 102 through telemetry module 136.

To conserve power in the telemetry module, a bi-stable actuator 142 assembly is preferred by embodiments of the present invention. Normally, for typical electrical actuators, power is needed to drive or actuate armature 144 and plunger 146 only in a single direction, after which they return to their steady-state position. Therefore, using the example above, power would only be required to be sent to actuator 142 from power module 134 when a digit "1" is to be sent. Furthermore, power from module 134 (through control module 128) would be required to be maintained the entire time while a digit "1" was being sent.

In contrast, a bi-stable actuator 142 would only require action and power from control module 128 whenever a change in position of armature 144 and plunger 146 is required. Therefore, power from control module 128 would only be necessary to briefly reposition plunger 146 and would not be required to be maintained throughout the sending of the digit "1" as required with a traditional actuator. Such bi-stable actuators have built-in potential energy (through permanent magnets) to maintain the switching device in one of the two stable positions. Only a low level of electrical power, in the form of a very short duration trigger pulse, is needed to tip the energy balance so that actuator 144 can switch to the other position.

Figure 5A:
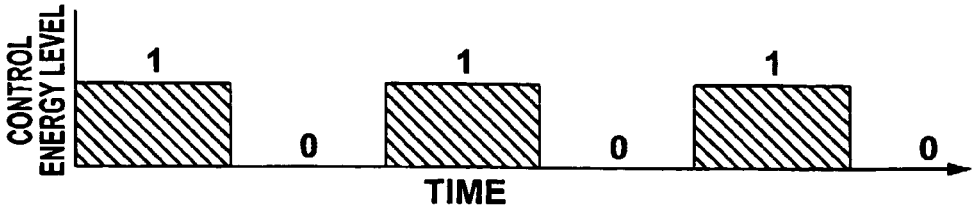
FIG. 5A is a graphical representation of power consumption for an actuator assembly in accordance with preferred embodiments of the present invention.
Figure 5B:
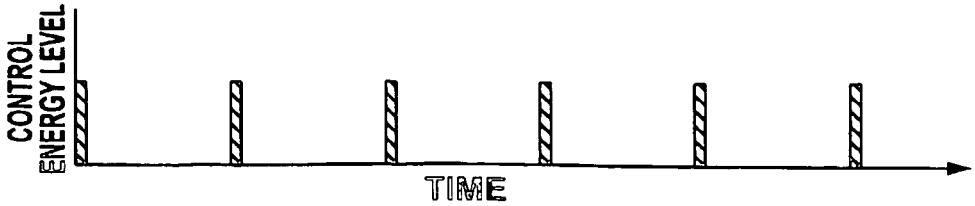
FIG. 5B is a graphical representation of power consumption for a bi-stable actuator assembly in accordance with preferred embodiments of the present invention.

Referring now to FIG. 5, the power saving effect of a bi-stable actuator 144 assembly can be seen. FIG. 5A depicts energy input for a conventional actuator assembly and FIG. 5B depicts the same for a bi-stable actuator assembly. Using the bi-stable technology, power input is only required during the transition period of a digit change, e.g. from "1" to "0" or vice versa. Power is saved when the width of the triggering pulse is smaller than 50% of the digit time as can be seen by comparing FIGS. 5A-5B. With the bi-stable actuator, no power will be consumed if the digit sent does not change. Therefore, the total power consumption for telemetry depends on the total number of digit transitions, not the duration of transmission for a particular digit (or the transmission frequency). For instance, if four measurements of 15-bit each are to be sent with 50% "0" and 50% "1" in the data and about 30 switching operations are needed, then a 30 W solenoid with a trigger pulse width of 20 ms would consume 0.6 J per switch operation, making the total power consumption 18 J.

Figure 6A:
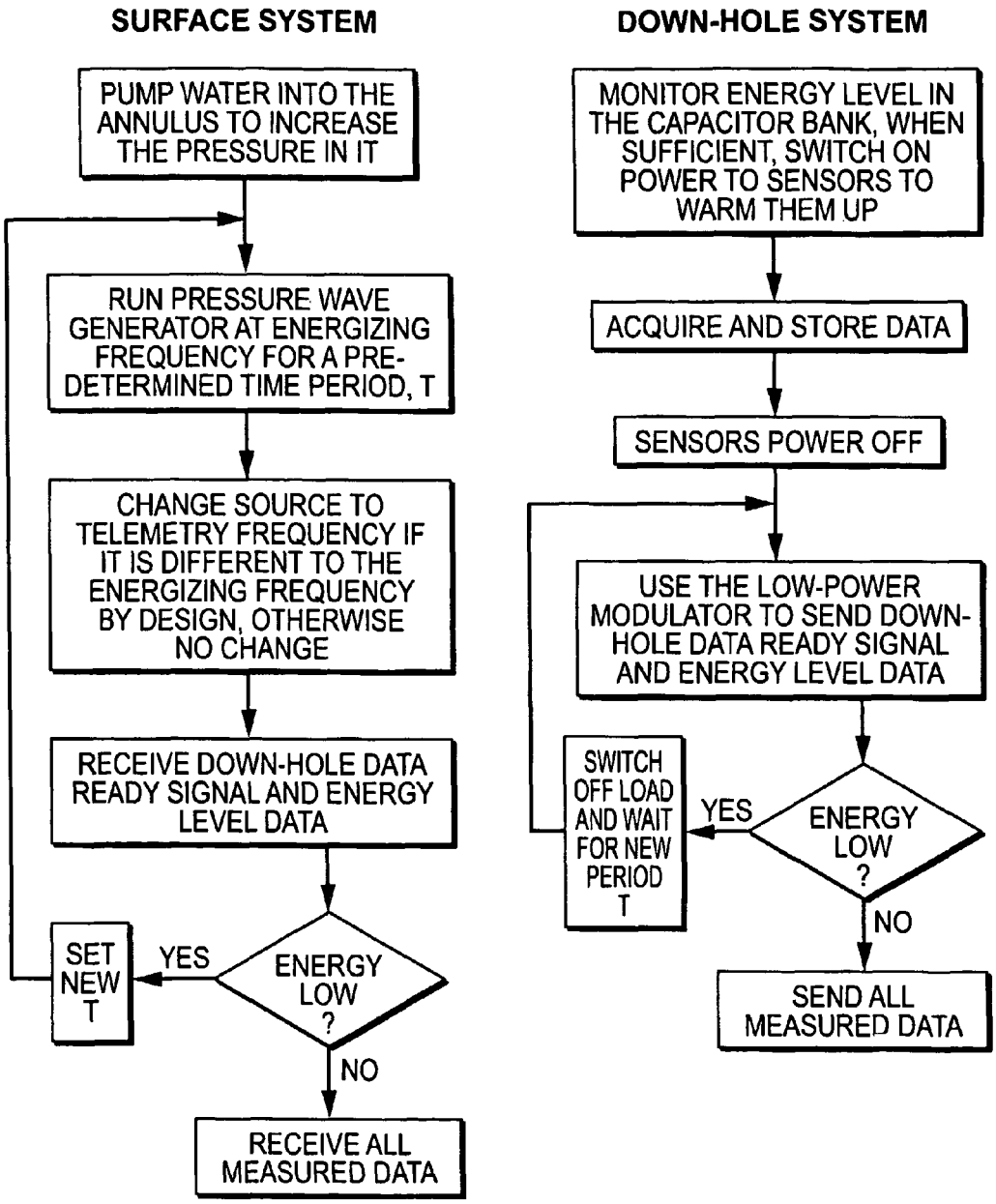
FIG. 6A is a flow chart diagram depicting an operation procedure to acquire data using a downhole communications system in accordance with preferred embodiments of the present invention.
Figure 6B:
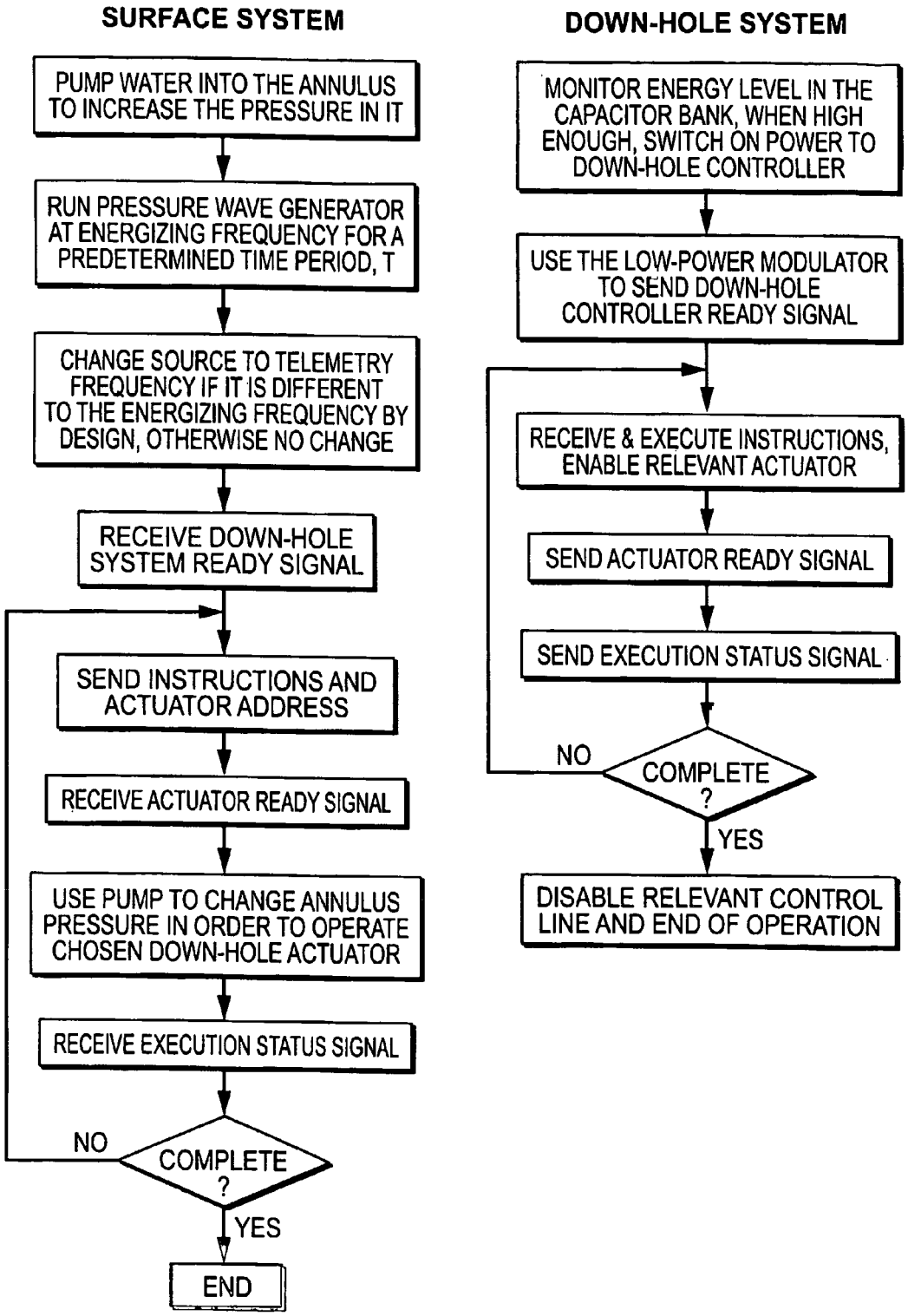
FIG. 6B is a flow chart diagram depicting an operation procedure to control downhole actuators using a downhole communications system in accordance with preferred embodiments of the present invention.

Referring now to FIGS. 6A and 6B, methods to use downhole communications system 100 in accordance with preferred embodiments of the present invention are described. The process typically begins with the pumping of water, via a surface pipe, into the annulus between a string of casing and a string of tubing until the pressure reaches a certain level, typically to a few hundred pounds per square inch. Next, a surface pressure wave generator generates pressure waves to energize the down hole mechanical to electrical energy converter over a pre-determined period of time, T. During this energizing period, pressure wave generator sends a pressure wave of appropriate frequency, typically from 1 Hz to 100 Hz, and appropriate amplitude, typically a few tens to a few hundreds of pounds per square inch, through surface pipe to downhole assembly.

This wave propagates into the liquid filled annulus and reaches the down-hole system with some attenuation. The down-hole energy converter converts the pressure wave energy into electrical energy with the electrical current generated thereby stored in a capacitor bank or storage module. Preferably, the capacitance of storage module is sufficient to provide a smooth supply voltage to the array of downhole devices during the data acquisition and telemetry period. Typically, the energizing process takes a few tens of minutes to build up a sufficient amount of electrical energy in the capacitor bank. Optionally, an electronic energy monitor can monitor the energy level in the storage module and can close an isolation switch (as shown in FIG. 3) when an appropriate level is reached to power up the electronics and sensors.

Usually, sensor electronics require a warming up period before they are capable of making accurate measurements. As can be seen in FIG. 6A, a downhole controller can accommodate this phenomenon by switching on the sensors before actual measurements are to be taken. The warm-up period will vary by design and manufacture of the sensor components, but will typically be several minutes in length. To compensate for the electrical consumption during the warm-up period and the data accumulation period that follows, the pressure wave source on the surface can be kept running to supply energy to the sensors and the storage module.

Following the charging and sensor warm-up phases, the data acquisition phase begins. During data acquisition, downhole sensors measure various parameters and transmit data relating to those measurements to the control module. The control module receives these measurements and converts them to digital codes and stores them for transmission to the surface. Once all downhole data is acquired and transmitted to and stored within the control module, the resulting information is ready to be transmitted to the surface unit through binary bit stream telemetry. To conserve power, the downhole sensors are switched off to maximize power available to the telemetry operation.

Before data transmission, the frequency and/or amplitude of the pressure wave generator may need to be changed to differentiate a telemetry wave condition from an energy wave condition. This differentiation may be necessary or desirable for a variety of reasons. Particularly, the design and construction of both the telemetry modulator and energy converter might be such that they each have distinct optimal operating conditions. Furthermore, the differentiation can also be used to signal to downhole sensors to switch from data accumulation (and energy conversion) to data telemetry mode. However, data telemetry module and energy conversion module can nonetheless be configured so that such a frequency and/or amplitude change is not necessary.

As exemplified by FIGS. 6A and 6B, the downhole communications system sends a signal indicating that acquired data is ready for transmission to the surface. Alternatively, the communications system can send a measurement of the amount of energy stored in the downhole capacitor to the surface unit so that it can determine whether the downhole system has sufficient energy to supply the entire telemetry operation. If the surface unit determines that insufficient energy is retained within the downhole energy storage device, a second energizing operation can be initiated to charge the storage device (capacitor) to obtain the necessary amount of energy. Alternatively, the processor in the downhole communications system can be configured to calculate the amount of energy needed in the capacitor to transmit the necessary data and can delay sending the ready signal to the surface until sufficiently charged. Alternatively still, two surface pressure wave sources with different frequencies can be operated at the same time, one for continuous energizing during telemetry and the other for data transmission and modulation. Data acquisition is complete when all data stored within the downhole control module has been transmitted to the surface unit. Following the transmission of all data, the surface pressure wave generator can be deactivated, thereby allowing the sensors in the downhole communications system to consume the remaining power and shut down. When another series of measurements is required, the surface wave generator assembly can again be activated to begin the charging phase once again.

Referring now to FIG. 6B an operating procedure in accordance with preferred embodiments of the present invention can be described. Following the pressurization and energization of the downhole system as described above, the downhole system can send a system ready message to the surface unit. Upon receiving the surface ready signal, the surface unit can then send a pressure wave message containing instructions relating to the downhole operations to the control module. These instructions can include, but are not limited to, directions as to which sensors data is to be recorded or transmitted from and, in multi-actuator systems, which actuator transmission is desired to be received from. The instructions are preferably detected by a downhole pressure transducer connected to control module for deciphering and execution downhole.

For example, to open or close a downhole completion valve, a message containing the valve address and the operation command can be sent. The downhole control module, after receiving the instruction, can open a low power valve enabling the access to the hydraulic control line that connects the relevant valve. The downhole system then signals to surface that the down-hole control line is enabled and ready for actuation from the surface. The completion valve/actuator can then be operated from the surface by pumping up or bleeding down annulus pressure. This pressure increase or decrease is transmitted through the down-hole hydraulic control line to reach the valve/actuator. Next, the downhole control module can detect the status of the valve and transmit to the surface whether or not the actuation was a success. As can be seen in the loop in FIG. 6B, the surface and down-hole systems can repeat the actuation cycle as necessary. Following completion of the actuation, the downhole communications system can disable the relevant control line, so that actuation of other devices can be performed. Finally, when monitoring and or control are complete, the surface unit can be constructed to be easily removed and relocated to a new well to perform similar tasks.

Numerous embodiments and alternatives thereof have been disclosed. While the above disclosure includes the best mode belief in carrying out the invention as contemplated by the inventors, not all possible alternatives have been disclosed. For that reason, the scope and limitation of the present invention is not to be restricted to the above disclosure, but is instead to be defined and construed by the appended claims.

What is claimed:

1. A method to periodically communicate with a sensor installed downhole in a completed well, the method comprising periodically and repeatedly:

activating a surface pressure wave generator to transmit pressure waves to excite a downhole energy converter, wherein said energy converter comprises one of a magnetostrictive material or a single crystal piezoelectric;

storing electrical energy from said downhole energy converter in a downhole energy storage device;

after storing electrical energy in the device, powering up the sensor and a downhole control module both powered by electrical energy from the device;

accumulating data received from said downhole sensor in the downhole control module;

transmitting said data from said downhole control module to a surface signal processing unit, wherein the step of transmitting said data from said downhole control module to said surface signal processing unit comprises said module controlling a pressure wave telemetry unit to modify and reflect the pressure waves back to the surface location; and deactivating the surface pressure wave generator, allowing electrical energy remaining in the storage device to be consumed and shutting down the sensor and control module.

2. The method of claim 1, further comprising sending a ready signal from said downhole control module.

3. The method of claim 1 further comprising exciting said downhole energy converter to charge said downhole energy storage device for a predetermined period of time.

4. The method of claim 1 further comprising interrupting transmission of said data from said downhole control module to said surface processing unit to re-charge said downhole energy storage device.

5. The method of claim 1 further comprising activating a Helmholtz resonator in said pressure wave telemetry unit to transmit said data to said surface signal processing unit.

6. The method of claim 1 further comprising using said pressure wave telemetry unit to shift a phase of the pressure waves generated by said pressure wave generator.

7. The method of claim 1 further comprising switching a frequency of said pressure waves generated by said surface pressure wave generator between an energization frequency and a telemetry frequency.

8. The method of claim 1 wherein said downhole sensor is coupled with a plurality of downhole actuators.

9. The method of claim 8 comprising operating said downhole actuators with pressure from the surface to open and close downhole valves.

10. The method of claim 8 further comprising sending an instruction from said surface signal processing unit to said downhole control module to direct activation of a downhole valve.

11. The method of claim 10 further comprising increasing annulus pressure to engage said downhole valve into a directed position.

12. The method of claim 1 further comprising installing said sensor, said energy converter, said storage device, and control module as part of a permanent completion.

13. The method of claim 1 further comprising pressurizing an annulus around tubing within the well before activating the surface pressure wave generator.

14. The method of claim 1 wherein the downhole energy storage device stores electrical energy in a capacitor.

15. The method of claim 1 further comprising monitoring the amount of electrical energy stored in the downhole energy storage device.

16. The method of claim 1 wherein powering up the sensor and control module is an automatic consequence of storing electrical energy in the storage device.

17. The method of claim 1 wherein the telemetry unit includes a bi-stable actuator which uses permanent magnets to maintain it in either one of two stable positions and consumes electrical energy only when changing between said positions.

18. The method of claim 1 further comprising sending an instruction from said surface signal processing unit to said downhole control module to direct activation of a downhole valve and then increasing pressure in an annulus around tubing within the well to move said downhole valve into a directed position.

* * * * *